US008662037B2

(12) United States Patent
Ting et al.

(10) Patent No.: US 8,662,037 B2
(45) Date of Patent: Mar. 4, 2014

(54) STRUCTURE OF DRIVING MEMBER FOR VARIABLE VALVE OF ENGINE

(75) Inventors: Jung-Feng Ting, Kaohsiung (TW); Hung-Yu Su, Kaohsiung (TW)

(73) Assignee: Kwang Yang Motor Co., Ltd., Kaohsiung (TW)

( * ) Notice: Subject to any disclaimer, the term of this patent is extended or adjusted under 35 U.S.C. 154(b) by 105 days.

(21) Appl. No.: 13/420,626

(22) Filed: Mar. 15, 2012

(65) Prior Publication Data

US 2012/0325170 A1 Dec. 27, 2012

(30) Foreign Application Priority Data

Jun. 27, 2011 (TW) ..... 100122406 A

(51) Int. Cl.
*F01L 1/34* (2006.01)

(52) U.S. Cl.
USPC ..... 123/90.16; 123/90.39

(58) Field of Classification Search
USPC ..... 123/90.16, 90.39
See application file for complete search history.

(56) References Cited

U.S. PATENT DOCUMENTS 4,726,332 A * 2/1988 Nishimura et al. ..... 123/90.16
RE34,596 E * 5/1994 Masuda et al. ..... 123/90.16
6,938,597 B2 * 9/2005 Klein et al. ..... 123/90.65

* cited by examiner

*Primary Examiner* — Zelalem Eshete
(74) *Attorney, Agent, or Firm* — Leong C. Lei

(57) ABSTRACT

Disclosed is a structure of driving member for variable valve of engine, in which a first intake cam, an exhaust cam, and a second intake cam are mounted, in such an order, to a camshaft. An intake valve driving member has first and second driving members respectively in rolling engagement with the first and second intake cams. The first driving member forms a through hole. The second driving member forms a through hole. The interconnection member forms a through hole. The through holes are connected to and communicate with each other to form a hydraulic cylinder, which receives therein at least one piston that is movable to selectively locate between the first driving member and the interconnection member or between the second driving member and the interconnection member to change the lift of an intake valve.

10 Claims, 11 Drawing Sheets

STRUCTURE OF DRIVING MEMBER FOR VARIABLE VALVE OF ENGINE

TECHNICAL FIELD OF THE INVENTION

The present invention generally relates to a structure of driving member for variable valve of engine, and more particularly to a structure of driving member for variable valve of engine that simplifies engineering of lift variation of engine valve and enhances operation performance of engine.

DESCRIPTION OF THE PRIOR ART

A variable lift mechanism for valve of an engine 1, as shown in FIG. 1, comprises first and second driving members 21, 22 arranged atop a valve 2. The second driving member 22 is a member composed of multiple links. The first and second driving members 21, 22 can individually drive the valve 2 in order to allow the lift of the valve 2 to be changed. In other words, when the first driving member 21 drives the valve 2, the valve 2 shows a lift of small opening and when the second driving member 22 drives the valve 2, the valve shows a lift of large opening, so as to realize switching between intake and exhaust valve for variable lift of valve 2 to accommodate different operational speed of the engine 1.

The variable lift mechanism of valve of the engine 1 uses first and second driving members 21, 22 that are arranged atop the valve 2 to individually drive the valve 2 in order to realize switching between intake and exhaust valve for variable lift of valve 2 to accommodate different operational speed of the engine 1. However, when either one of the first and second driving members 21, 22 is in operation to drive the valve 2, both the first and second driving members 21, 22 are simultaneously driven by an intake cam of a cam shaft (not shown) and consequently, the rotary inertia of the first and second driving members 21, 22 is increased. The increase of the rotary inertia of the first and second driving members 21, 22 means that friction horsepower is increased and the output horsepower of the engine 1 is reduced. Further, when the rotary inertia of the first and second driving members 21, 22 is increased, to maintain normal operation of the valve 2, the spring coefficient of a spring element 23 for automatically returning the valve 2 must be properly increased, namely K constant for elasticity being increased, in order to properly return the valve 2 that is depressed down by the first or second driving member 21, 22 in order to close an intake channel 2*a*. However, the increase of K constant of the spring element 23, in one hand, causes an increase of the friction horsepower, which in turn leads to reduction of output horsepower of the engine 1 and, in the other hand, the increase of K constant of the spring element 23 makes the returning of the valve 2 be conducted in an excessive speed, which in turn leads to easy damage of the valve 2 or a damage of an intake opening of the intake channel 2*a*, eventually causing incomplete sealing of the intake channel 2 and making the engine 1 abnormal in operation. Thus, how to reduce the rotary inertia of the first and second driving members 21, 22 is an issue to be overcome by the motorcycle industry.

SUMMARY OF THE INVENTION

The primary object of the present invention is to provide a structure of driving member for variable valve of engine, wherein the engine which comprises a crankcase, a cylinder block mounted on the crankcase, and a cylinder head mounted on the cylinder block. The cylinder head comprises an intake port, an intake valve, an exhaust port, and an exhaust valve. A camshaft base is arranged between the intake valve and the exhaust valve. The camshaft base comprises a camshaft that is driven by a timing chain. An axle of an intake valve driving member and an axle of an exhaust valve driving member are mounted on the cylinder head. The camshaft comprises two intake cams and an exhaust cam that are respectively operable to push the intake valve driving member and the exhaust valve driving member. The cams mounted on the camshaft are, in sequence, the first intake cam, the exhaust cam, and the second intake cam. The intake valve driving member comprises a first driving member in rolling engagement with the first intake cam and a second driving member in rolling engagement with the second intake cam and an interconnection member that is selectively in movement with the first driving member or the second driving member to have the intake valve opening and closing. The first driving member comprises a positioning hole, a through hole, and a first push roller. The second driving member comprises a positioning hole, a through hole, and a second push roller. The interconnection member comprises a positioning hole, a through hole, and a depressing section in engagement with the intake valve. The positioning hole of the first driving member, the positioning hole of the second driving member, and the positioning hole of the interconnection member are mounted to the axle of the intake valve driving member. The through hole of the first driving member, the through hole of the second driving member, and the through hole of the interconnection member are connected and in communication with each other to form a hydraulic cylinder. The hydraulic cylinder receives therein at least one piston. As such, the rotary inertial of the intake valve driving member is effectively reduced thereby reducing the friction horsepower and increasing the output horsepower of the engine and further, the speed by which the intake valve returns is reduced to thereby eliminating the risk of damaging the intake valve and the intake channel and thus improving operation performance of the engine.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
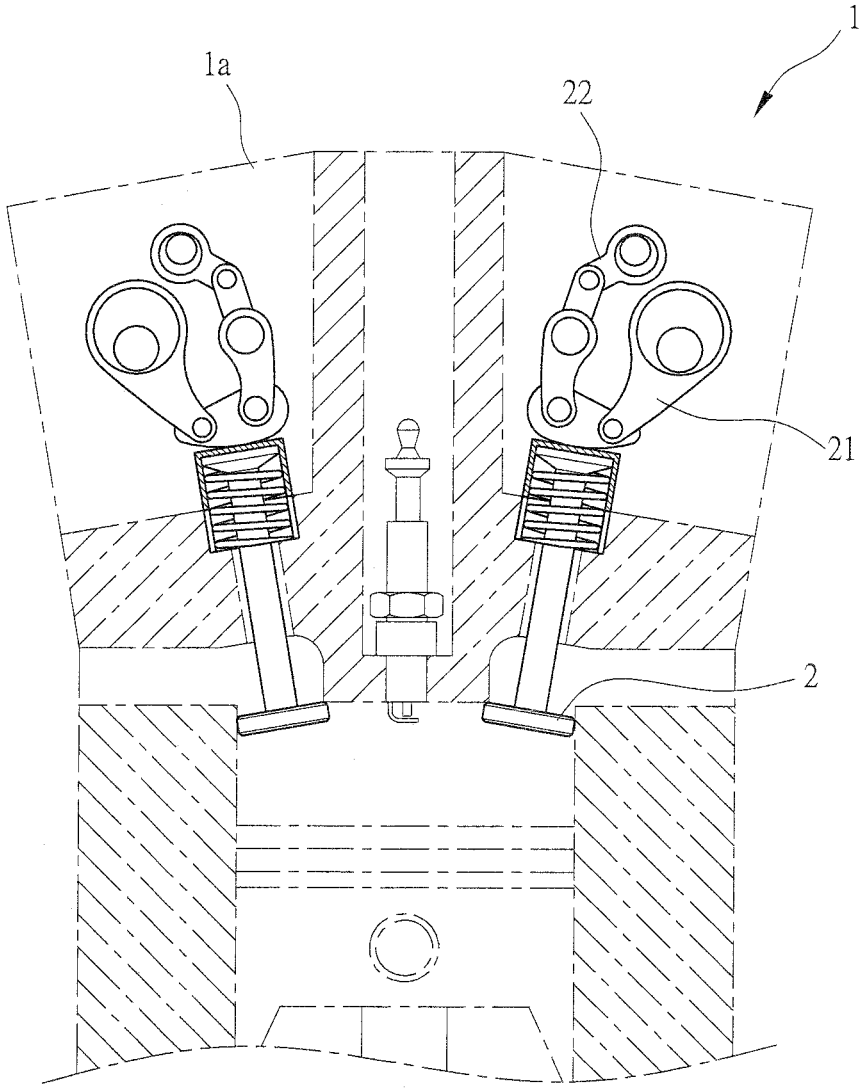
PRIOR ART FIG.1
FIG. 1 is a schematic view showing a conventional cylinder head.
Figure 2:
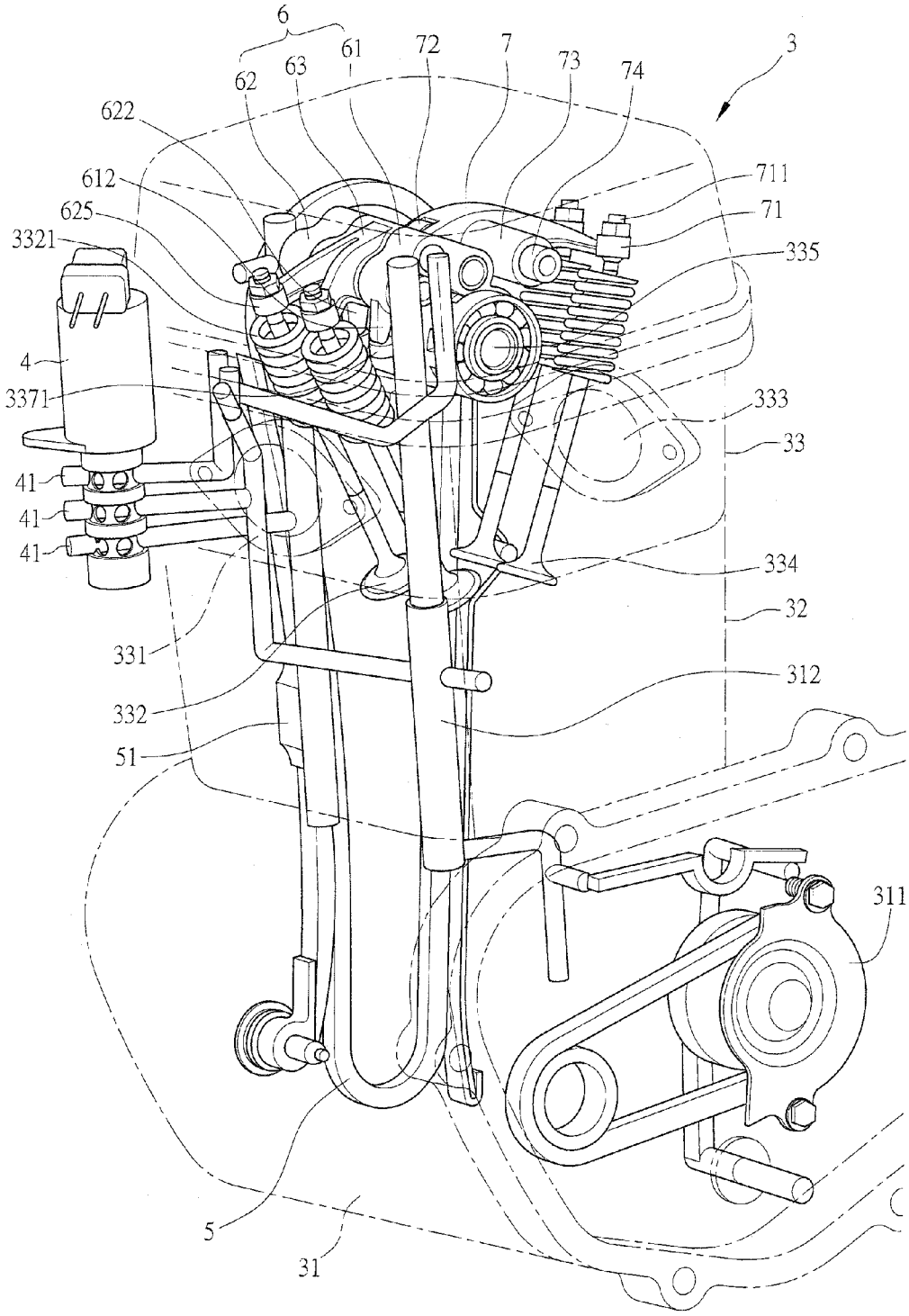
FIG. 2 is a schematic view showing a cylinder head of engine according to the present invention.
Figure 8:
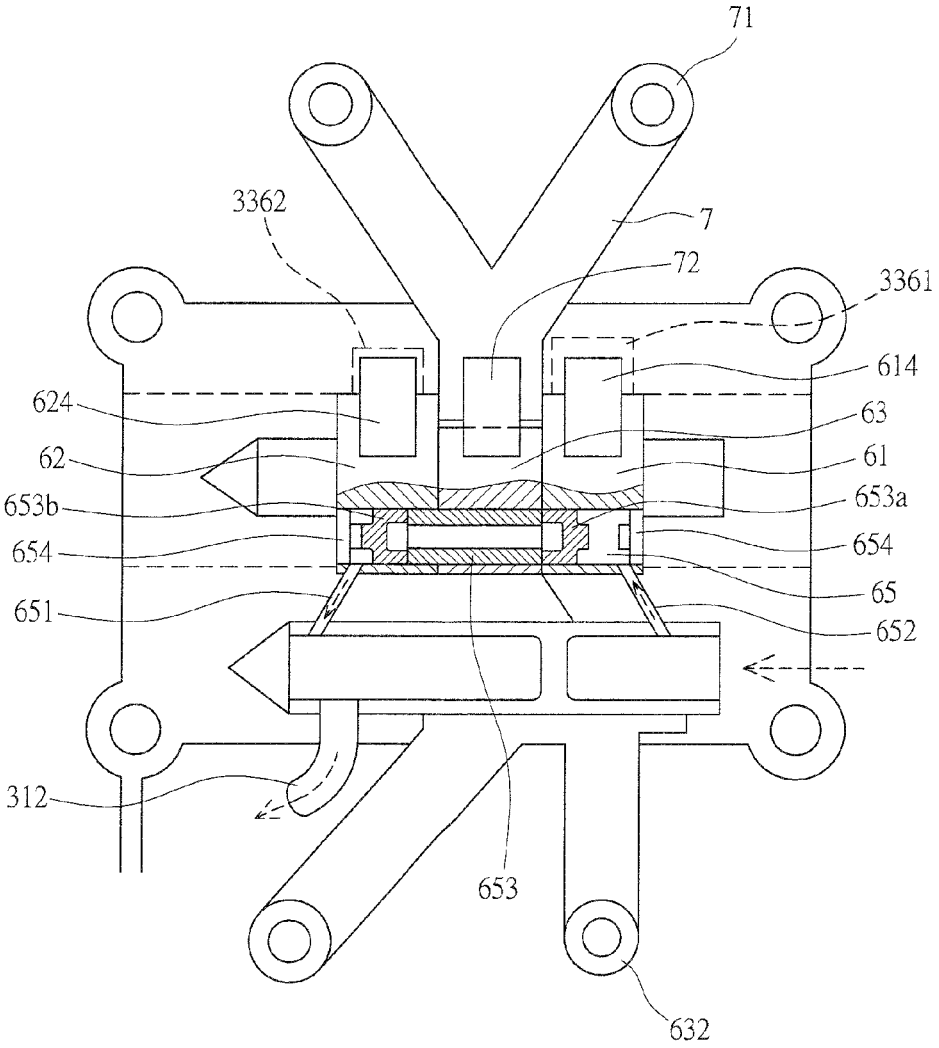
FIGS. 8 and 9 show operations of the present invention.

Referring first to FIGS. 2 and 8, the present invention provides an engine 3, which comprises a crankcase 31, a cylinder block 32 mounted on the crankcase 31, and a cylinder head 33 mounted on the cylinder block 32.

The crankcase 31 receives therein a crankshaft (not shown). The crankcase 31 comprises therein an oil pump 311. The oil pump 311 pumps oil into a primary oil supply passage 312. The primary oil supply passage 312 extends from the crankcase 31 through the cylinder block 32 to the oil control valve 4 mounted to the cylinder head 33. The oil control valve 4 supplies the oil through a flow channel to a hydraulic cylinder 65 located in the cylinder head 32.

The cylinder block 32 is arranged above the crankcase 31 and allows a timing chain 5 to extend therethrough. The cylinder block 32 comprises a timing chain tensioner 51 arranged at an intake port 331 side of the cylinder head 33.

Figure 3:
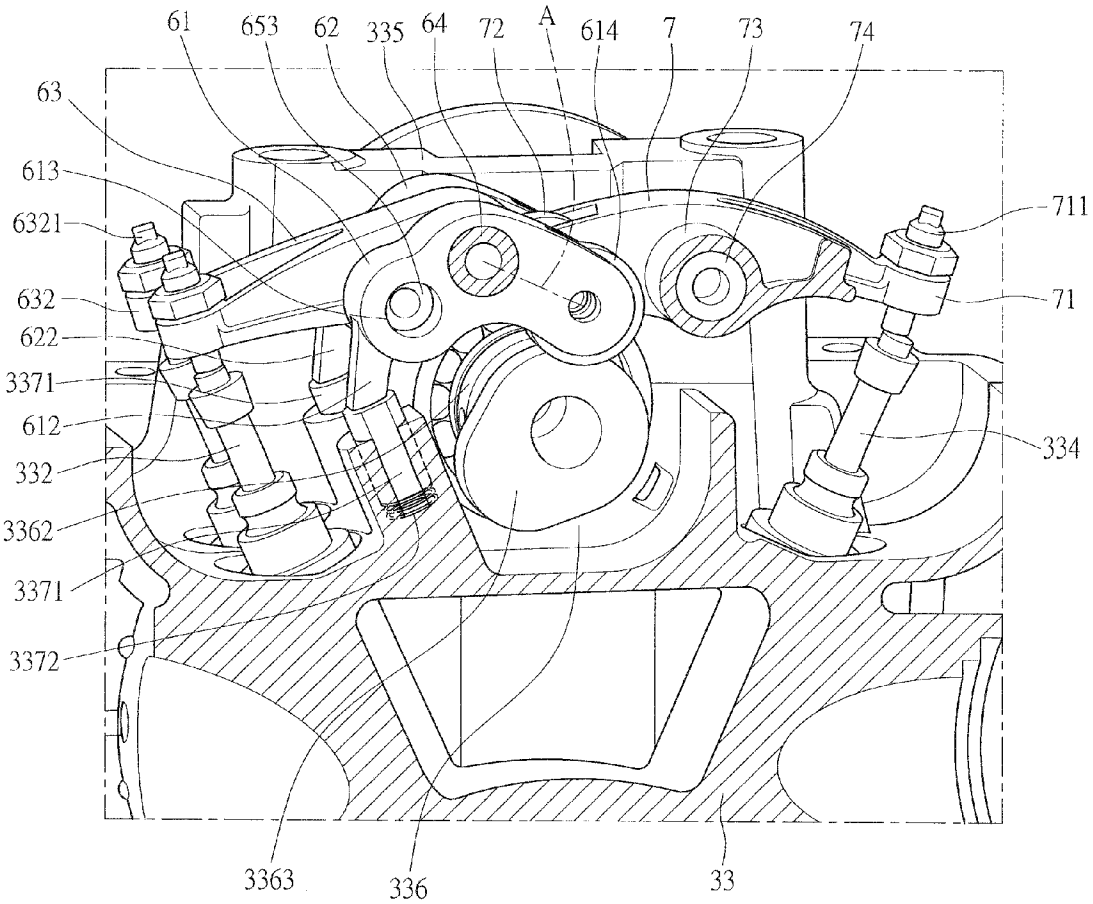
FIG. 3 is a partial cross-sectional view of the cylinder head according to the present invention.
Figure 4:
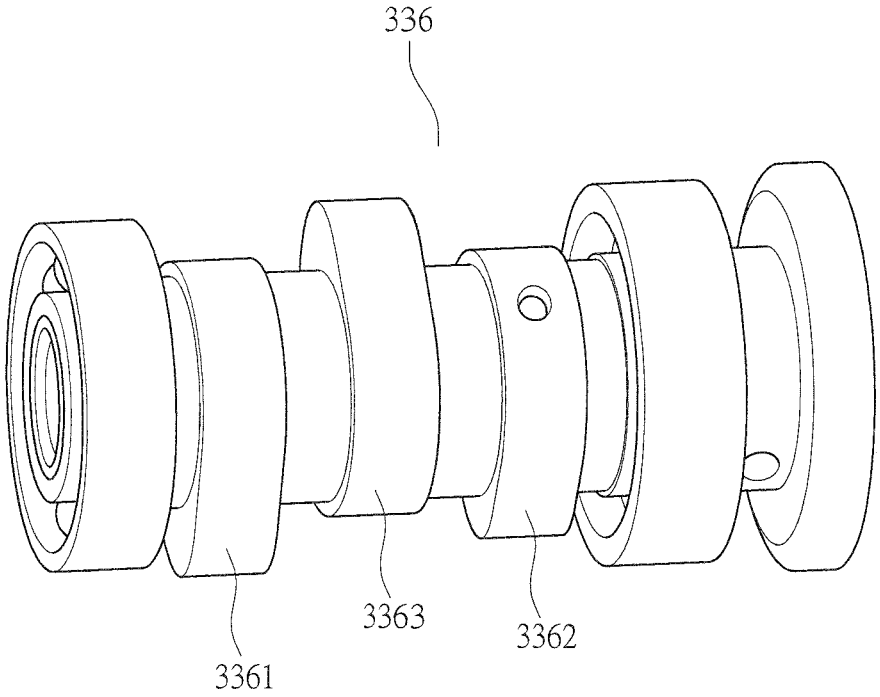
FIG. 4 is a schematic perspective view showing a camshaft according to the present invention.
Figures 5, 5A:
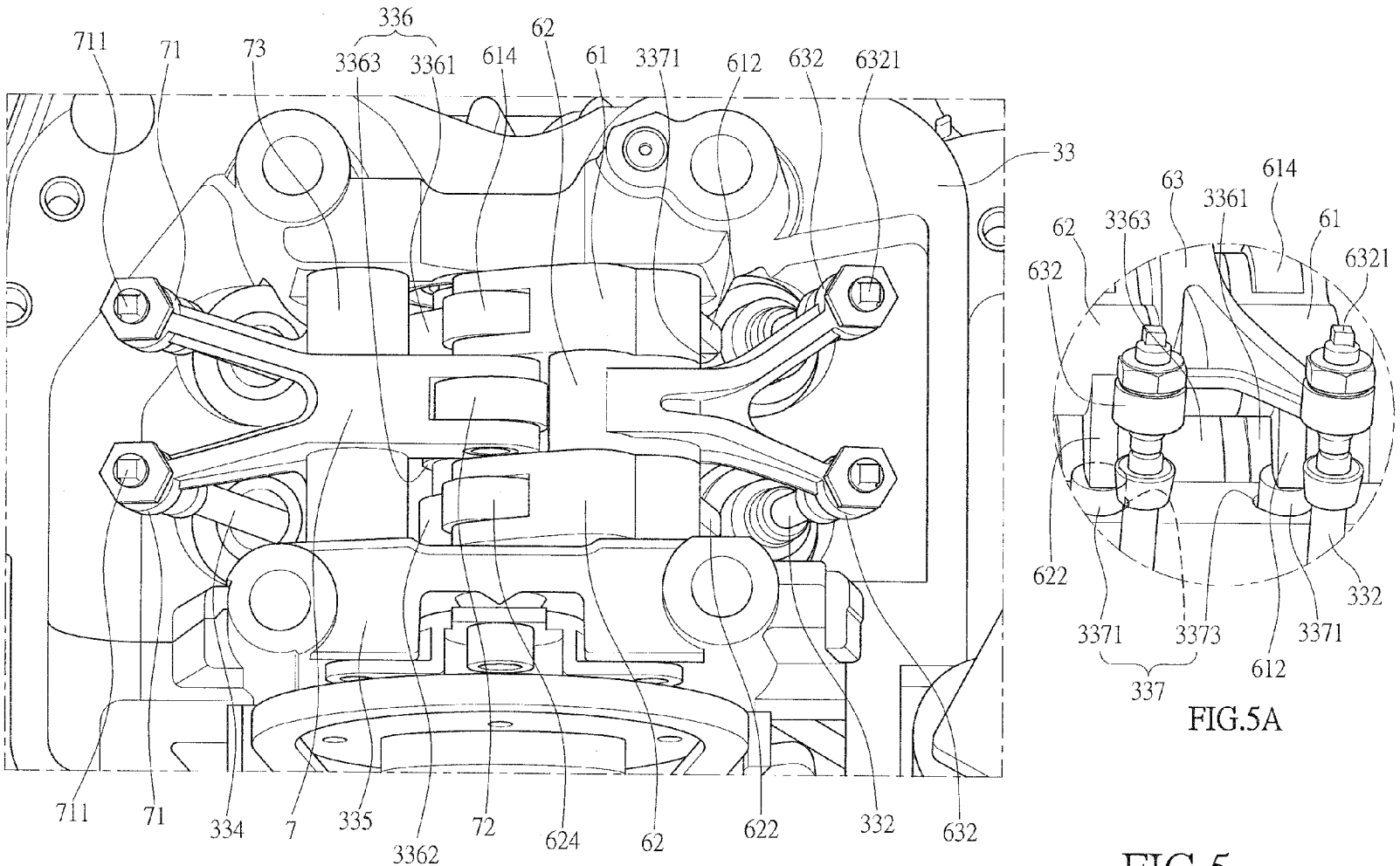
FIG. 5 is a top plan view of the cylinder head according to the present invention.
FIG. 5A is a partial enlarged view of FIG. 5.
Figure 6:
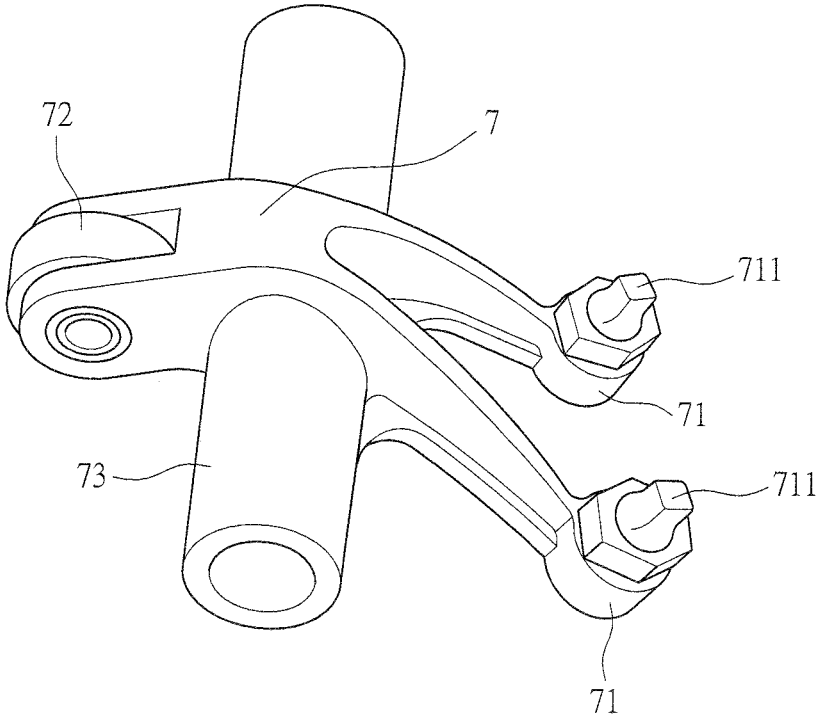
FIG. 6 is a schematic view showing an exhaust valve driving member according to the present invention.
Figure 7:
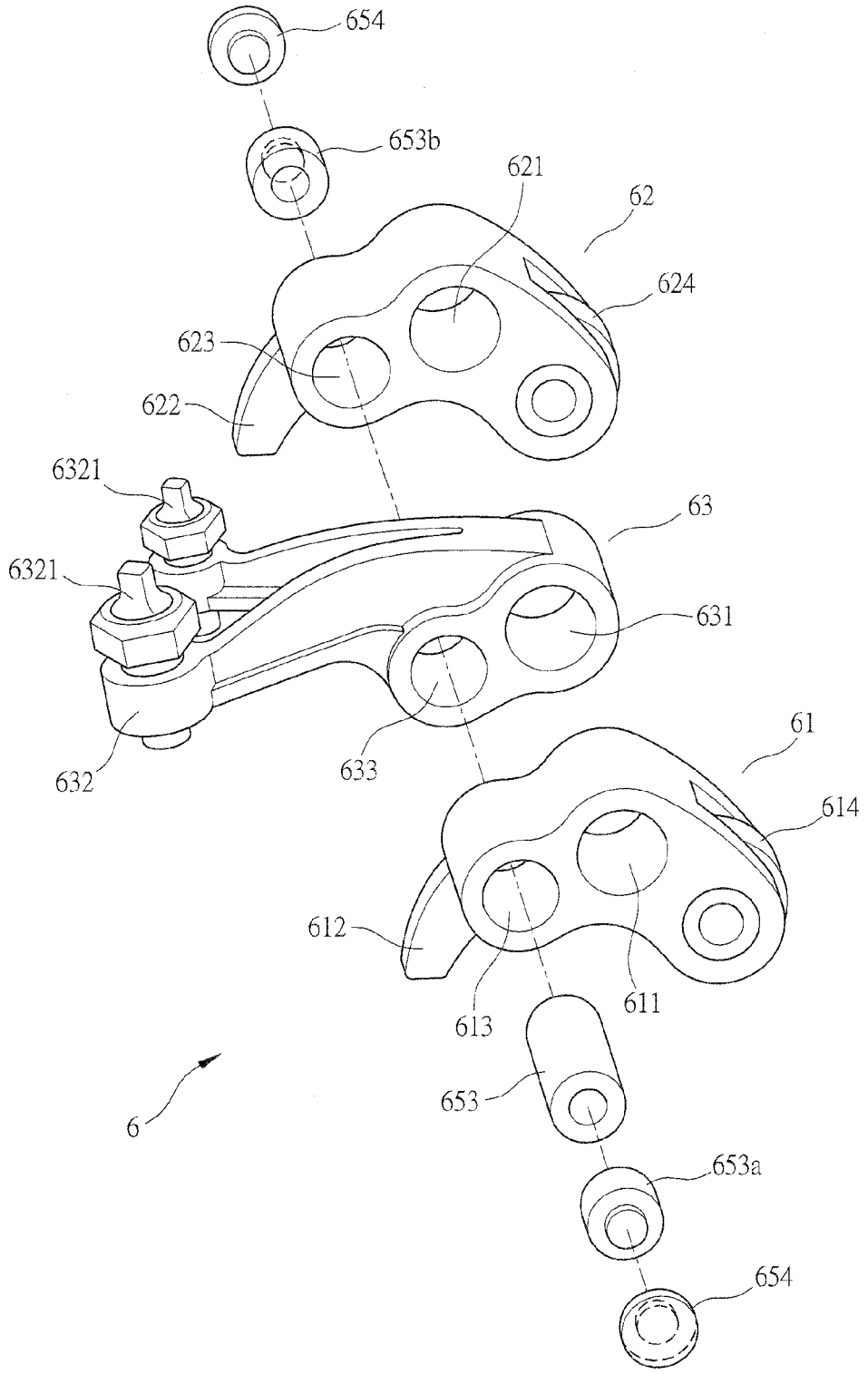
FIG. 7 is a schematic exploded view of an intake valve driving member according to the present invention.

The cylinder head 33 comprises, at an intake side, an intake port 331 and an intake valve 332 that is encompassed by a spring element 3321 and an exhaust port 333 and an exhaust valve 334 arranged at an exhaust side. Referring to FIGS. 2, 3, 4, and 5 and 5A, the cylinder head 33 comprises an integrally formed camshaft base 335 between the intake valve 332 and the exhaust valve 334. The camshaft base 335 supports a camshaft 336 that is driven by the timing chain 5. The camshaft 336 comprises a first intake cam (which is high lift cam) 3361, an exhaust cam 3363, and a second intake cam (which is a low lift cam) 3362 mounted thereon. The first intake cam 3361, the second intake cam 3362, and the exhaust cam 3363 function to push an intake valve driving member 6 and an exhaust valve driving member 7 of the intake valve 332 and the exhaust valve 334 during the rotation of the camshaft 336. The intake valve driving member 6 and the exhaust valve driving member 7 are made of a light-weight metal, such as aluminum magnesium alloys, in an integral form in order to reduce the weights of the intake valve driving member 6 and the exhaust valve driving member 7. Referring to FIGS. 3, 5, and 6, the exhaust valve driving member 7 has an end forming a depressing section 71, which is engageable with the exhaust valve 334 and has a tip to which a gap adjusting piece 711 is mounted, and an opposite end carrying an exhaust-side push roller 72, which is set in rolling engagement with the exhaust cam 3363. A tubular sleeve 73 extends sideways from one side of the exhaust valve driving member 7 and the tubular sleeve 73 receives an axle 74 therein, whereby the axle 74 functions to stably position the exhaust valve driving member 7 on the camshaft base 335. The exhaust cam 3363 of the camshaft 336 may thus drive the exhaust-side push roller 72 to have the depressing section 71 depressing down the exhaust valve 334 thereby opening the exhaust valve for discharging exhaust gas. The gap between the depressing section 71 and the exhaust valve 334 can be adjusted by means of 711 in order to maintain the lift of the exhaust valve 334. Referring to FIGS. 3, 5, and 7, the intake valve driving member 6 comprises a first driving member 61, an interconnection member 63, and a second driving member 62. The first driving member 61 comprises a positioning hole 611 formed in a front portion thereof, a positioning bar 612 projecting from a front lower side of the positioning hole 611, and a through hole 613 formed rearward of the positioning hole 611 and also comprises a first push roller 614 located rearward of the through hole 613. The second driving member 62 comprises, corresponding to the first driving member 61, a positioning hole 621, a positioning bar 622, a through hole 623, and a second push roller 624. The interconnection member 63 forms a positioning hole 631 and has a front end frontward of the positioning hole 631 and forming a depressing section 632 extending therefrom. The depressing section 632 has a front tip to which a gap adjusting piece 6321 is mounted. A through hole 633 is formed rearward of the positioning hole 631. The first push roller 614 of the first driving member 61 is in rolling engagement with the first intake cam 3361 of the camshaft 336 and the second push roller 624 of the second driving member 62 is in rolling engagement with the second intake cam 3362 of the camshaft 336. The depressing section 632 of the interconnection member 63 is in engagement with the intake valve 332. Gap between the depressing section 632 and the intake valve 332 is adjustable through the gap adjusting piece 6321 in order to maintain the lift of the intake valve 332. An axle 64 is received in the positioning holes 611, 621, 631 in order to stably position the first driving member 61, the interconnection member 63, and the second driving member 62 on the camshaft base 335, whereby the first driving member 61, the interconnection member 63, and the second driving member 62 are oscillateable about the axle 64. Further, as shown in FIG. 3, the through holes 613, 623, 633 of the first driving member 61, the interconnection member 63, and the second driving member 62 are all located between the depressing section 632 of the interconnection member 63 and the positioning holes 611, 621, 631. In other words, the positioning holes 611, 621, 623 of the first driving member 61, the interconnection member 63, and the second driving member 62 are located between the through holes 613, 623, 633 and the first and second push rollers 614, 624, namely the through holes 613, 623, 633 are located below lines A respectively connecting between the first and second push rollers 614, 624 and centers of the positioning holes 611, 621, 623 to thereby effectively reduce the overall height of the cylinder head 33.

Figure 11:
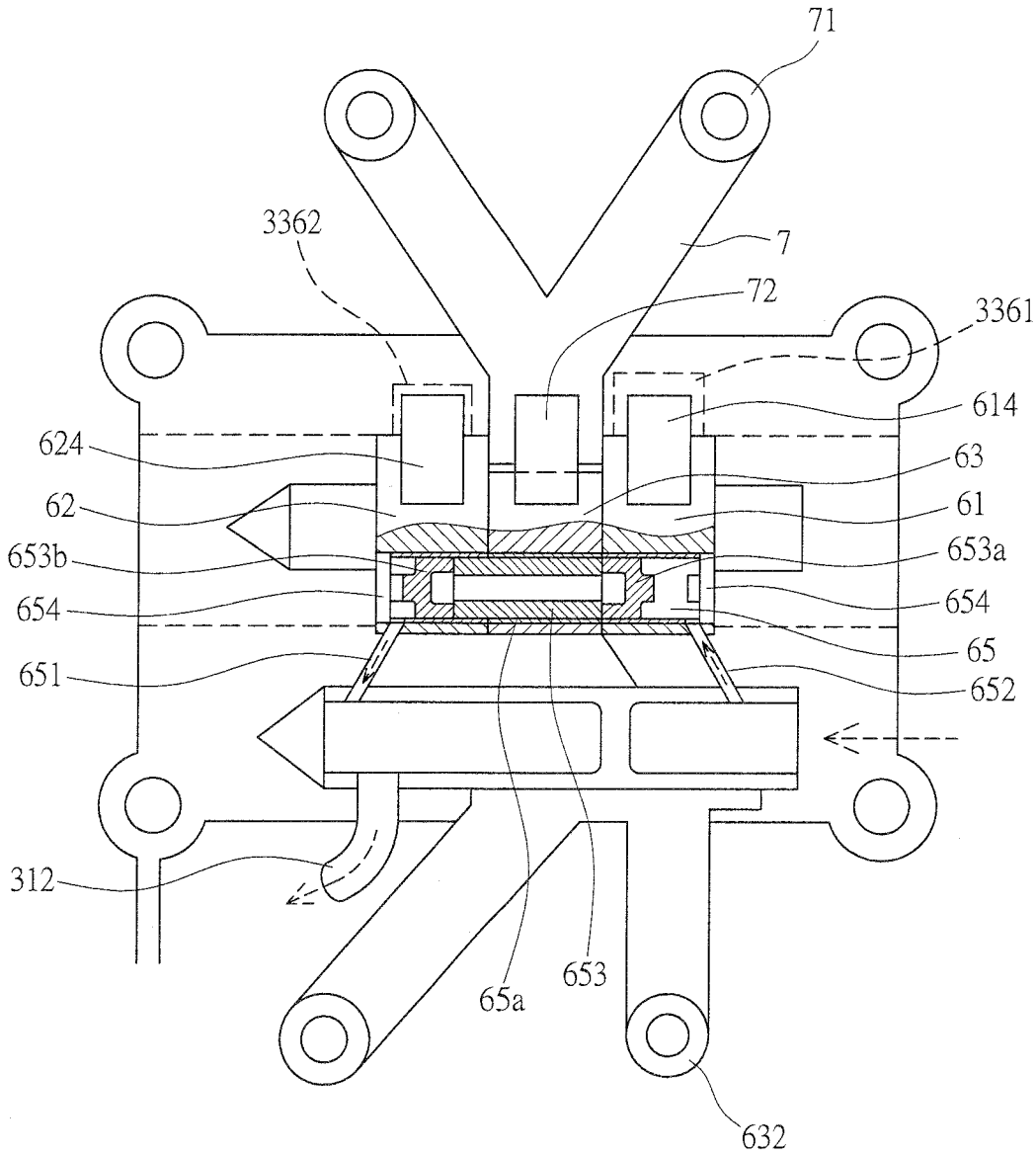
FIG. 11 is a schematic view showing the operation of the cylinder head according to the present invention.

Referring to FIGS. 5, 5A, 7, 8, 9, and 10, the through hole 613 of the first driving member 61, the through hole 633 of the interconnection member 63, and the through hole 623 of the second driving member 62 are connected to and in communication with each other to form a hydraulic cylinder 65. A first flow channel 651 and a second flow channel 652 are respectively formed at opposite ends of the hydraulic cylinder 65. The hydraulic cylinder 65 receives therein at least one piston 653, which has two opposite ends to which constraint pistons 653*a*, 653*b* are respectively coupled in order to improve positioning of the piston 653. The opposite ends of the hydraulic cylinder 65 are closed by covers 654. The hydraulic cylinder 65 is set in communication through a primary oil supply passage 312 with the oil control valve 4 in order to receive the supply of power fluid. The hydraulic cylinder 65 has an inner wall 65*a* that is made of a wear-resistant material, such as high carbon steel and tool steel in order to improve the wear resistance of the hydraulic cylinder 65. Further, as shown in FIG. 11, a bushing 65*b* is selectively fit in the hydraulic cylinder 65 and the bushing 65*b* is similarly made of a wear-resistant material, such as high carbon steel and tool steel in order to improve the wear resistance of the hydraulic cylinder 65. Further, the piston 653 is made of high toughness material, such as low carbon steel, in order to extend the service life of the piston 653.

As such, the oil control valve 4 controls the supply of power fluid to flow in/out of the hydraulic cylinder 65 through the first flow channel 651 or the second flow channel 652 to selectively set the piston 653 between the first driving member 61 and the interconnection member 63 or between the driving member 63 and the second driving member 62. Further, the cylinder head 33 located below the positioning bars 612, 622 is provided with a limiting mechanism 337, which comprises a limiting bar 3371, a spring 3372, and a pressure release hole 3373. The limiting mechanism 337 supports the depression of the positioning bars 612, 622 in order to ensure that the through hole 613 of the first driving member 61 and the through hole 623 of the second driving member 62 are located at desired positions. In case the limiting mechanism 337 is subjected to over-depression by the positioning bars 612, 622, the pressure release hole 3373 may timely release the pressure in order to maintain movability of the piston 653 within the hydraulic cylinder 65.

Figure 9:
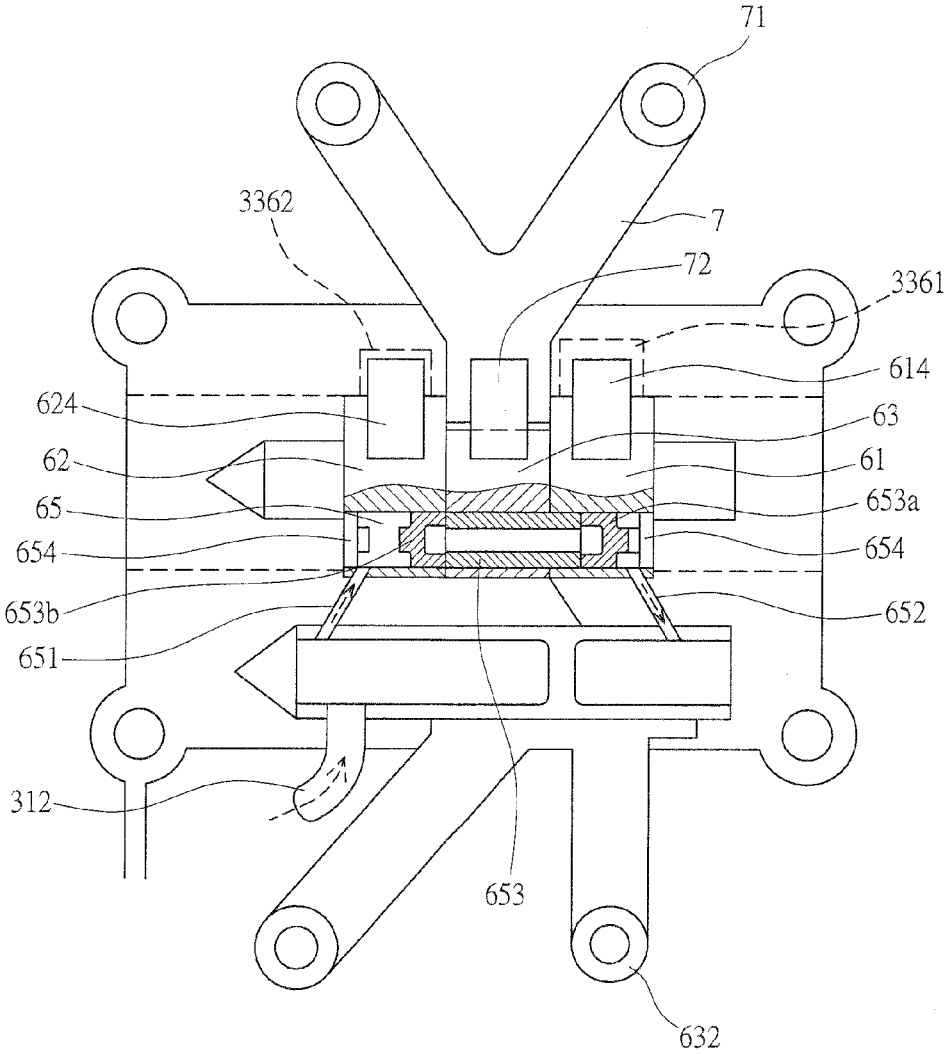
Figure 10:
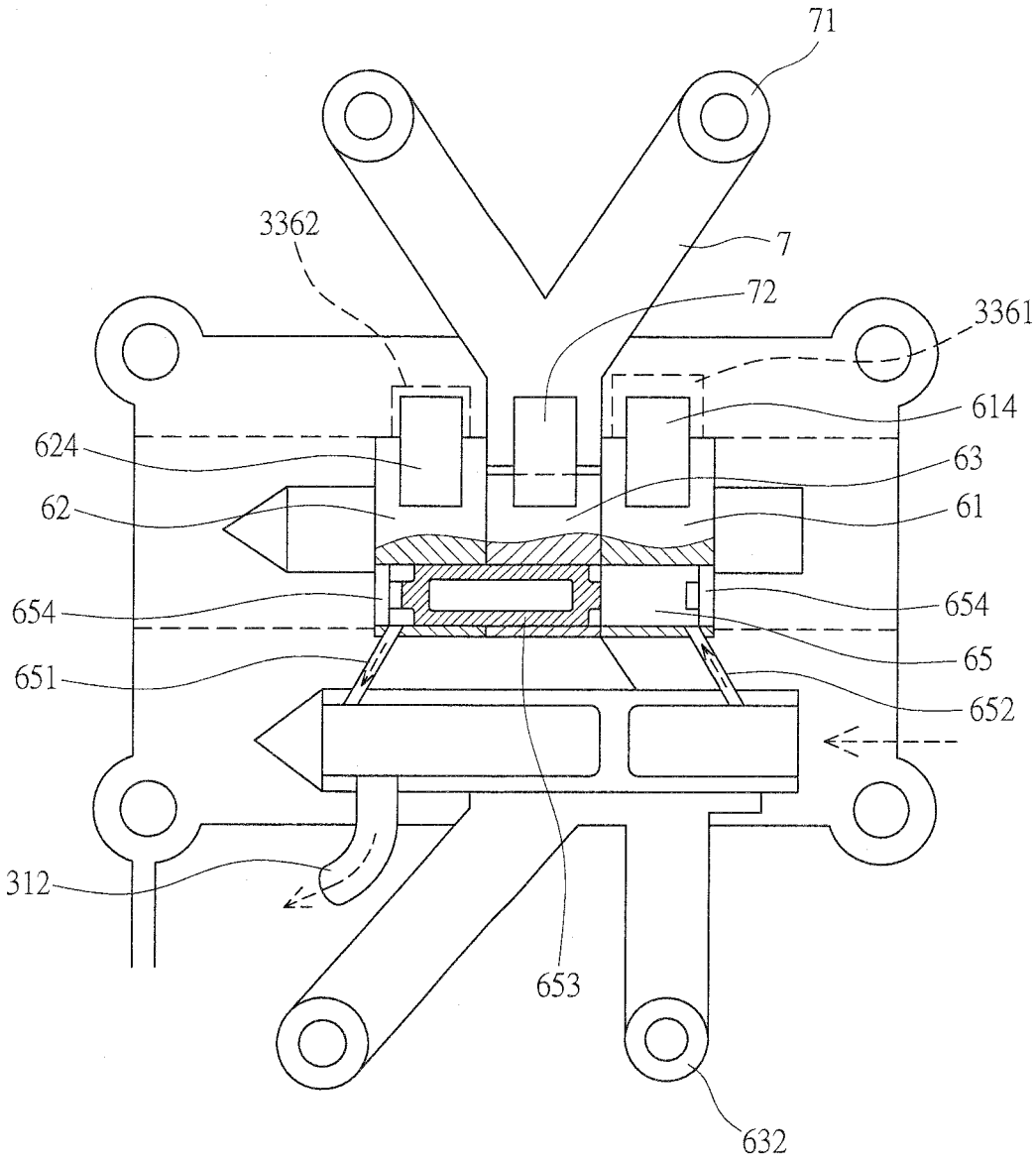
FIG. 10 is a schematic view showing a piston according to another embodiment of the present invention.

To operate, as shown in FIGS. 2, 3, 8, 9, and 10, an oil pump 311 arranged inside the crankcase 31 delivers oil to the primary oil supply passage 312, which extends from the crankcase 31 through the cylinder block 32 to communicate the oil control valve 4 arranged in the cylinder head 33. The oil control valve 4 then drives the oil into the cylinder head 33 to flow into the first flow channel 651 or the second flow channel 652 in order to reach inside the hydraulic cylinder 65. Further, referring to FIGS. 8, 9, and 10, a control center ECU (not shown) of the engine 3 detects the moving condition of the vehicle and when it is determined that the valve needs to be opened in a low lift extent, the control center ECU of the engine 3 controls the oil control valve 4 to supply oil from the first flow channel 651 or the second flow channel 652 into the hydraulic cylinder 65, as shown in FIG. 8, whereby the hydraulic pressure is applied to move the piston 653 to a location between the interconnection member 63 and the second driving member 62. Under this condition, the second driving member 62 is pushed by the second intake cam 3362 (which is the low lift cam) to drive the interconnection member 63 to move, whereby the interconnection member 63 uses the depression section 632 to depress down the intake valve 332 so as to set the intake valve 332 in low lift opening. Although the first driving member 61 is simultaneously pushed by the first intake cam 3361 of the camshaft 336, due to the piston 653 of the hydraulic cylinder 65 being not located between the first driving member 61 and the interconnection member 63, the first driving member 61 is pushed alone by the first intake cam 3361 of the camshaft 336. Further, when the engine 3 is caused by a change of the moving condition of the vehicle to have the intake vale changed to high lift opening, the control center ECU of the engine 3 controls the oil control valve 4 to supply oil from the first flow channel 651 or the second flow channel 652 into the hydraulic cylinder 65. As shown in FIG. 9, the hydraulic pressure causes the piston 653 to move to a location between the first driving member 61 and the interconnection member 63. Under this condition, the first driving member 62 is pushed by the first intake cam 3361 (which is the high lift cam) to cause the interconnection member 63 to move, whereby the interconnection member 63 uses the depressing section 632 to depress down the intake valve 332, so as to set the intake valve 332 in high lift opening. Although the second driving member 62 is simultaneously pushed by the second intake cam 3362 of the camshaft 336, due to the piston 653 of the hydraulic cylinder 65 being not located between the second driving member 62 and the interconnection member 63, the second driving member 62 is pushed alone by the second intake cam 3362 of the camshaft 336. This realizes variation of valve of the engine 3.

The effectiveness of the present invention is that the camshaft 336 is provided with the first intake cam 3361, the second intake cam 3362, and the exhaust cam 3363, and the intake valve driving member 6 comprises the first driving member 61, the interconnection member 63, and the second driving member 62, and the through hole 613 of the first driving member 61, the through hole 633 of the interconnection member 63, and the through hole 623 of the second driving member 62 are connected together to form the hydraulic cylinder 65, in which the piston 653 is received, so that the first driving member 61 is selectively set in movement with the interconnection member 63 or the interconnection member 63 is selectively set in movement with the second driving member 62 for changing the lift of the intake valve 332 of the engine 3, whereby engineering of lift variation of the intake valve 332 of the engine 3 is simplified. Further, when the first driving member 61 is moved with the interconnection member 63, the second driving member 62 is moved alone, not cooperating with the interconnection member 63 to drive the intake valve 332 to rotate and when the interconnection member 63 is moved with the second driving member 62, the first driving member 61 is moved alone, not cooperating with the interconnection member 63 to drive the intake valve 332 to rotate, whereby the rotary inertia of the intake valve driving member 6 can be effectively reduced. With the rotary inertial of the intake valve driving member 6 reduced, the K constant of the spring element 3321 that functions to return the intake valve 332 can be lowered and the diameter of the spring element 3321 reduced. This, on one hand, reduces the friction horsepower, due to the reduction of the rotary inertial of the intake valve driving member 6, to thereby increase the output horsepower of the engine 3 and on the other hand, the reduction of the diameter of the spring element 3321 helps reducing the speed that the intake valve 332 returns, thereby eliminating the potential risk of damaging the intake valve 332 and intake channel and thus improving the operation performance of the engine 3.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A structure of driving member for variable valve of engine, wherein the engine comprises a crankcase, a cylinder block mounted on the crankcase, and a cylinder head mounted on the cylinder block, the cylinder head comprising an intake port, an intake valve, an exhaust port, and an exhaust valve, a camshaft base being arranged between the intake valve and the exhaust valve, the camshaft base comprising a camshaft that is driven by a timing chain, and an axle of an intake valve driving member and an axle of an exhaust valve driving member being mounted on the cylinder head, the camshaft comprising two intake cams and an exhaust cam that are respectively operable to push the intake valve driving member and the exhaust valve driving member, characterized in that the cams mounted on the camshaft are, in sequence, the first intake cam, the exhaust cam, and the second intake cam, the intake valve driving member comprising a first driving member in rolling engagement with the first intake cam and a second driving member in rolling engagement with the second intake cam and an interconnection member that is selectively in movement with the first driving member or the second driving member to have the intake valve opening and closing, wherein the first driving member comprises a positioning hole, a through hole, and a first push roller; the second driving member comprises a positioning hole, a through hole, and a second push roller; the interconnection member comprises a positioning hole, a through hole, and a depressing section in engagement with the intake valve, the positioning hole of the first driving member, the positioning hole of the second driving member, and the positioning hole of the interconnection member being mounted to the axle of the intake valve driving member, the through hole of the first driving member, the through hole of the second driving member, and the through hole of the interconnection member being connected and communicating with each other to form a hydraulic cylinder, the hydraulic cylinder receiving therein at least one piston, wherein the cylinder head comprises a limiting mechanism in engagement with the first driving member and the second driving member, the limiting mechanism comprising a limiting bar, a spring, and a pressure release hole; the first driving member and the second driving member are each provided with a positioning bar, which is set in engagement with the limiting bar of the limiting mechanism; the positioning bar of each of the first driving member and the second driving member is located between the positioning hole and the depressing section.

2. The structure of driving member for variable valve of engine according to claim 1, wherein when the first driving member is moved with the interconnection member, the intake valve is in high lift opening and when the second driving member is moved with the interconnection member, the intake valve is low lift opening.

3. The structure of driving member for variable valve of engine according to claim 1, wherein the intake valve driving member and the exhaust valve driving member are made of light-weight metal, an inner wall of the cylinder head is made of a wear-resistant material, and the piston is made of a high toughness material.

4. The structure of driving member for variable valve of engine according to claim 1, wherein the cylinder head comprises a bushing fit therein, the bushing being made of a wear resistant material.

5. The structure of driving member for variable valve of engine according to claim 3, wherein the cylinder head comprises a bushing fit therein, the bushing being made of a wear resistant material.

6. The structure of driving member for variable valve of engine according to claim 1, wherein the through hole of each of the first driving member and the second driving member is located between the push roller and the depressing section of the interconnection member and is located below a line connecting the push roller and a center of the positioning hole.

7. The structure of driving member for variable valve of engine according to claim 1, wherein the first driving member and the second driving member are both integrally formed.

8. The structure of driving member for variable valve of engine according to claim 1, wherein the first driving member and the second driving member are both integrally formed.

9. The structure of driving member for variable valve of engine according to claim 1, wherein the first driving member and the second driving member are both integrally formed.

10. The structure of driving member for variable valve of engine according to claim 1, wherein the depressing section comprises a gap adjusting piece.

* * * * *